US005269235A

United States Patent [19]

McGill et al.

[11] Patent Number: 5,269,235

[45] Date of Patent: Dec. 14, 1993

[54] THREE STAGE COMBUSTION APPARATUS

[75] Inventors: Eugene C. McGill, Skiatook; Kevin W. McQuigg, Tulsa, both of Okla.

[73] Assignee: Koch Engineering Company, Inc., Wichita, Kans.

[21] Appl. No.: 968,235

[22] Filed: Oct. 29, 1992

Related U.S. Application Data

[63] Continuation of Ser. No. 773,370, Oct. 7, 1991, abandoned, which is a continuation of Ser. No. 253,193, Oct. 3, 1988, abandoned.

[51] Int. Cl.[5] ..... F23G 5/00

[52] U.S. Cl. ..... 110/246; 110/212; 110/214; 110/215; 110/171; 588/206

[58] Field of Search ..... 110/212, 214, 215, 256, 110/246, 235, 234, 346, 171; 588/206

[56] References Cited

U.S. PATENT DOCUMENTS

| | | | |
|---|---|---|---|
| 3,072,457 | 1/1963 | Bloch | 423/213.7 |
| 3,581,490 | 6/1971 | Morris | 423/213.7 |
| 3,867,507 | 2/1975 | Meyerson | 423/212 |
| 3,873,671 | 3/1975 | Reed et al. | 423/235 |
| 3,911,083 | 10/1975 | Reed et al. | 423/235 |
| 4,154,811 | 5/1979 | Vona, Jr. et al. | 423/481 |
| 4,198,384 | 4/1980 | Robinson | 423/488 |
| 4,215,095 | 7/1980 | Harris et al. | 423/240 |
| 4,306,506 | 12/1981 | Rotter | 110/256 X |
| 4,335,084 | 6/1982 | Brogan | 423/213.5 |
| 4,405,587 | 9/1987 | McGill et al. | 423/235 |
| 4,462,318 | 7/1984 | Carbeau et al. | 110/238 |
| 4,519,993 | 5/1985 | McGill et al. | 423/235 |
| 4,811,555 | 3/1989 | Bell | 60/39.06 |
| 4,982,672 | 1/1991 | Bell | 110/214 X |
| 5,018,457 | 5/1991 | Brady et al. | 110/215 X |

FOREIGN PATENT DOCUMENTS

| | | | |
|---|---|---|---|
| 54-50470 | 4/1979 | Japan | 423/238 |
| 54-38431 | 11/1979 | Japan | 423/235 |
| 667342 | 2/1952 | United Kingdom | 423/235 |

*Primary Examiner*—Edward G. Favors

*Attorney, Agent, or Firm*—Dougherty, Hessin, Beavers & Gilbert

[57] ABSTRACT

A process for disposing of a waste chemical stream containing materials which can produce objectionable combustion products, such as $NO_x$, free bromine, carbon, particulates or ash, the process comprising the steps of passing the waste chemical stream to an oxidizing first zone where burning occurs in stoichiometric oxygen excess above about 2000° F.; then to a reducing second zone where reaction occurs in stoichiometric reduction at a temperature of above about 2000° F.; and then to an oxidizing third zone to oxidize the combustibles at temperatures of between about 1400° F. and 2000° F. The process provides high efficiency destruction of waste compounds, whether solid, liquid or gaseous, in a substantially $NO_x$ free manner. In the case of brominated compounds, the process generates HBr which is readily scrubbed.

26 Claims, 4 Drawing Sheets

THREE STAGE COMBUSTION APPARATUS

This is a continuation of copending application Ser. No. 07/773,370 filed Oct. 7, 1991 abandoned which is a continuation of application Ser. No. 07/253,193 filed Oct. 3, 1988, now abandoned.

BACKGROUND OF INVENTION

1. Field of the Invention

The present invention relates to the disposal of industrial waste streams, and more particularly but not by way of limitation, to an improved catalyst-free process for disposing of industrial waste streams containing materials that produce objectionable products when combusted in conventional combustion processes.

2. Brief Statement of the Prior Art

The destruction of industrial waste streams requires the process designer to consider and take into account many factors, and to balance these factors. Many environmental restraints are imposed, and the prior art processes for destroying such industrial waste streams reflect those restraints when dealing with such contaminants as nitrated compounds which produce oxides of nitrogen ($NO_x$), and with certain halogenated compounds which produce halogen gas.

Many prior art processes utilize a reducing zone into which an industrial waste stream is first injected. An example of such a process is taught in U.S. Pat. No. 3,873,671, issued to Reed et al. and entitled "Process for Disposal of Oxides of Nitrogen".

The Reed process provides for the burning of a hydrocarbon fuel with less than a stoichiometric amount of oxygen. The oxygen can be supplied by air, or by a stream of air containing oxides of nitrogen. The combustion products of the hydrocarbon fuel are then mixed with gases to be treated containing $NO_x$ in a ratio which provides an excess of oxidizable material, under conditions that enable a portion of the combustible products to be oxidized by oxygen made available from the decomposition of the $NO_x$, thus reducing the $NO_x$ content. This combined combustion mixture of nitrogen and other compounds, i.e., carbon monoxide, hydrocarbons, and other oxidizable materials, is thereafter cooled to a temperature in the range of from about 2000° F. to about 1200° F. with a cooling fluid which is substantially free of oxygen. To prevent venting excess combustibles into the atmosphere, the cooled mixture of nitrogen, combustion products and other oxidizable materials is thereafter mixed in a second zone with sufficient oxygen to convert substantially all of the oxidizable combustion products remaining to carbon dioxide and water while minimizing the reformation of oxides of nitrogen.

In Japanese Patent Application No. Showa 54-50470, published Apr. 20, 1979, a boiler is operated to reduce the $NO_x$ content of a waste combustion gas. In this process a primary fuel is initially burned to produce a waste gas containing $NO_x$ with excess oxygen; a secondary light petroleum fuel is then introduced into the combustion gases to convert the $NO_x$ therein to elemental nitrogen and more excessively reduced forms of nitrogen such as HCN and $NH_3$; and these compounds are then reoxidized back to elemental nitrogen in one or more stages with an oxygen-containing gas.

Other prior art processes have in similar manner taken advantage of the kinetics of combustion control for eliminating or controlling $NO_x$ and the like, such as:

U.S. Pat. No. 3,911,083 uses steam and hydrogen injection; U.S. Pat. No. 4,519,993 teaches a process for the safe destruction of an industrial waste stream which contains chemically bound nitrogen compounds without effecting flame propagation; and U.S. Pat. No. 3,867,507 provides a method for removing oxides of nitrogen as air contaminants. An early teaching of flame destruction of nitrous gases by flame combustion is found in British Patent No. 667,342.

Prior art combustion processes usually involve a reducing zone into which the wastes materials are first injected. If the materials are light gases or low boiling liquids, the waste materials can possibly be burned without producing excessive soot. However, if system controls fluctuate, or if heavy gases, vapors, liquids or solids are injected for destruction, soot can and often will be formed. This soot can lead to excessive buildup of coke deposits which can plug off the burner and combustion chambers. If halogens are also present, and if certain temperatures ranges are incurred, dioxanes and/or furans may be formed. This country's federal regulatory code requires for certain toxic wastes that combustion be carried out at temperatures in excess of 2200° F. with at least 3 percent excess oxygen. However, the by-products generated by many such wastes when combusted under these conditions preclude the use of combustion for destroying such wastes.

For $NO_x$ control, a first reducing zone will normally destroy essentially all $NO_x$ by reducing same to elemental nitrogen, providing that the temperature is high enough. As noted above, if free carbon (as particulates) is formed, the burnout of the contaminants then becomes a serious problem. To achieve burnout, the temperature must be greater than about 2000° F. with an excess of oxygen greater than about one volume percent. However, this reoxidation step under these conditions will regenerate $NO_x$ at substantial rates.

Control of the system is very difficult because soot (or smoke) can blind flame detectors and other safety devices which will then shut down the process; furthermore, oxygen analyzers and combustibles analyzers which are used for process control, can become plugged.

Should dioxanes be formed, temperatures of at least 2200° F. and an excess of oxygen of at least three volume percent is recommended by regulatory authorities for adequate destruction of such dioxanes. These conditions, as noted, will regenerate $NO_x$ at unacceptable levels.

What is needed is a process for the safe destruction of waste materials that produce objectionable products when combusted in an atmosphere of excess oxygen. The present inventive process provides this and is well suited for the disposal of hazardous chemicals containing halogenated and nitrated waste materials.

SUMMARY OF INVENTION

The present invention provides an improved catalyst-free process for disposing of a waste chemical stream which contains materials that can produce objectionable products, such as $NO_x$, free bromine, smoke or the like in conventional combustion processes. The process comprises burning the waste chemical stream in a first zone with a stoichiometric oxygen excess to achieve a first combustion effluent which is then burned in a second zone in stoichiometric excess of a reducing agent to achieve a second combustion effluent which is substantially free of $NO_x$.

The second combustion effluent is then reacted in a third zone with sufficient oxygen to achieve oxidation of the combustibles and to achieve a third combustion effluent which is substantially $NO_x$ free.

More specifically, the process of the present invention comprises oxidizing a gaseous, liquid and/or solid waste chemical stream in the first zone at a temperature in excess of about 2000° F., and preferably in excess of about 2200° F., in stoichiometric oxygen excess to assure complete oxidation of the waste chemical stream. The first combustion effluent from the first zone is then combusted in the second zone in which reducing conditions are maintained; namely, a stoichiometric excess of a reducing agent is provided to achieve stoichiometric reduction of the oxygen to achieve a second combustion effluent substantially free of $NO_x$. The preferred temperature in the second zone is preferably greater than about 2000° F. Finally, the second combustion effluent from the second zone is reacted in a third zone with an effective amount of oxygen to oxidize the combustibles of the second combustion effluent, preferably at a temperature between about 1400° F. to about 2000° F. so as to achieve a third combustion effluent which is substantially free of $NO_x$.

An object of the present invention is to provide a three stage combustion process for disposing of waste chemical streams containing materials that produce objectionable products when combusted by prior art combustion processes.

Other objects, advantages and features of the present invention will become apparent to those skilled in the art from a reading of the following description in conjunction with the accompanying drawings and appended claims.

BRIEF DESCRIPTION OF DRAWINGS

Drawings accompany and are made a part of the present disclosure. Such drawings and description thereof are merely illustrative of the invention, the precise scope of which is defined in the appended claims. Further, auxiliary equipment, such as valves, flow meters and the like, has been omitted from the drawings for the sake of clarity since illustration of such equipment is not required for an understanding of the invention. In the drawings:

DESCRIPTION

The present invention provides a 3 stage combustion process for burning materials that produce objectionable off products when combusted in an atmosphere of excess oxygen. That is, the 3 stage catalyst-free combustion process of the present invention is not carried out in the presence of a catalyst. Examples of such materials include nitrated compounds, such as nitro benzene which produces $NO_x$, and brominated compounds, such as methyl bromide which produces gaseous $Br_2$. The present process is especially well suited for liquid waste materials that tend to crack and form soot when burned in a sub-stoichiometric oxygen atmosphere, and substantially any material, whether solid, liquid or gas, can be properly burned by the present invention.

The improved process of the present invention is designed for disposing, and sometimes reclaiming, chemical waste streams with various hazardous components which, when subjected to a combustion process, produce compounds which cannot be discharged to the atmosphere. Further, while such streams are suitable for injection into a combustion chamber in the presence of hydrocarbon fuels and the like, they frequently are not easily convertible to harmless compounds in quantities that can be safely discharged.

FIG. 1

Figure 1:
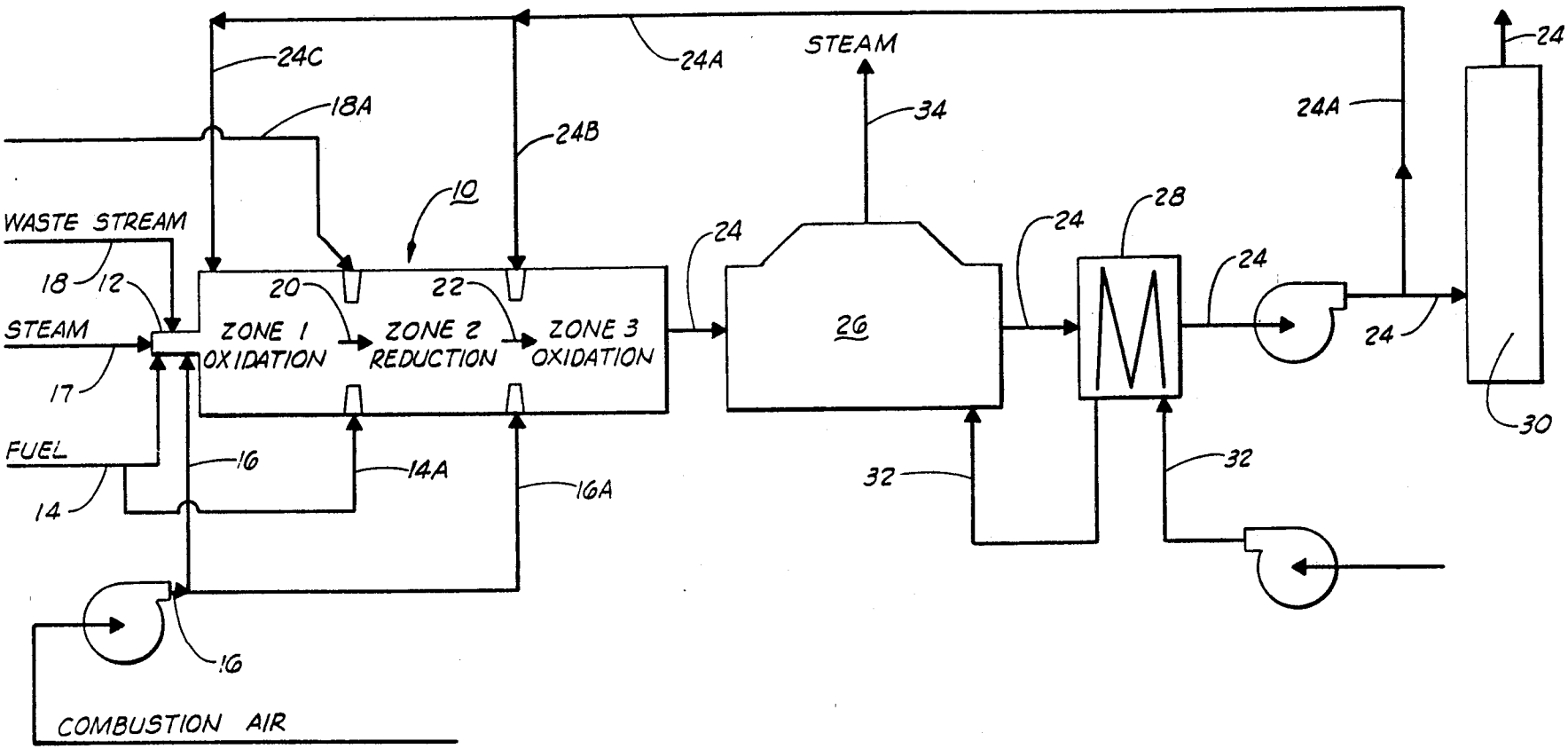
FIG. 1 is a schematic flow diagram showing one embodiment of the three stage combustion process of the present invention.

The present invention will now be described with reference to the drawings, wherein like numerals are used to identify like components. In FIG. 1, a combustion chamber 10, schematically depicted, has three combustion zones in linear alignment, namely: zone 1, an oxidation zone; zone 2, a reduction zone; and zone 3, another oxidation zone. A burner 12 is provided at the input end (zone 1) of the combustion chamber 10, and a fuel stream 14, a combustion air stream 16 and a waste chemical stream 18 are connected for injection to the burner 12. Also, an atomizing steam stream 17 can be injected into the burner 12. It will be appreciated that an oxygen stream can be used in lieu of the air stream 16, as is true for all of the examples of the present invention provided herein.

It will be noted in FIG. 1 that the fuel stream 14 has a conduit 14A which is used as necessary to inject fuel into zone 2, the reducing zone. Also, the combustion air stream 16, via conduit 16A, communicates combustion air to zone 3 as required. The waste chemical stream 18 is connected to the burner 12, and via conduit 18A, communicates a portion of the waste stream for injection into zone 2 when the waste chemical stream 18 has fuel value for serving as a reducing agent (provided environmental codes permit a portion of the waste stream to be so diverted and used as a reducing agent).

The fuel in fuel stream 14 can be any suitable hydrocarbon or other reducing agent which is preferably substantially completely oxidized to carbon dioxide and water upon combustion. For example, the fuel injected into the burner 12 of oxidizing zone 1 can comprise paraffinic, olefinic, or aromatic hydrocarbon compounds, including mixtures thereof, such as gasoline and fuel oil; oxygenated hydrocarbons such as aldehydes, ketones or acids; nitrated hydrocarbons and similar compounds; or coal. Desirably, the fuel stream 14A will have a low molecular weight, and comprise, for example, methane, ethane, and mixtures thereof, such as natural gas, or a hydrogen bearing gas.

Zone 1 produces a combustion effluent 20 (also sometimes hereinafter referred to as the first combusted waste effluent stream) which is passed immediately to reducing zone 2, which in turn produces a combustion effluent 22 (also sometimes referred to herein as the second combusted waste effluent stream). The combustion effluent 22 is passed immediately to oxidizing zone 3 from which is discharged a combustion effluent 24. The combustion effluent 24 (also sometimes referred to herein as the third combusted waste effluent stream) is passed through a waste heat boiler 26 and a heat exchanger 28 before passing to a stack 30 for discharge to the atmosphere. A boiler feed water 32 is passed through the heat exchanger 28 prior to passing to the waste heat boiler 26 and converted to a steam stream 34.

A portion of the combustion effluent 24 is returned as a quench diluent to zone 3 via conduits 24A and 24B, and a portion of the combustion effluent 24 is returned as a quench diluent to zone 1 via conduits 24A and 24C, to maintain the required zone temperatures. A quench diluent can also be injected into zone 2, as may be required. In general, the quench diluent can be any suitable stream, such as carbon dioxide, nitrogen, free water, steam or flue gas. In fact, as to zone 3, the quench diluent to this zone can be an oxygen bearing stream, such as air, but if such diluent is used in zone 3, the recycle of cooled effluent from zone 3 should not, in most cases, be used as a quench diluent to zones 1 and 2.

Burning of the waste stream 18 is accomplished in zone 1 which is operated with excess of oxygen above that required for stoichiometric combustion. The temperature and residence time should be consistent with good combustion practice with the limitation in the case of $NO_x$ generating materials that the temperature reached when reducing fuel is added in zone 2 must be greater than about 2000° F., and preferably greater than 2200° F.

Zone 2 is designed to treat the combustion effluent 20 with a fuel that will burn all free oxygen and the bound oxygen contained in $NO_x$. Preferably a temperature of 2200° F. minimum will be maintained in zone 2 and the fuel provided thereto will be in excess such that combustibles will be found in the combustion effluent 22 of between about 3 to 5 percent (wet volume), but it will be appreciated that the amount of combustibles is not limiting. That is, the combustion effluent 22 which passes to oxidizing zone 3 will have combustibles sufficient to maintain reducing conditions in zone 2 and these combustibles will be oxidized in zone 3 by the oxygen (or suitable oxidant) provided by conduit 16A.

In many cases it will be desirable to operate zones 2 and 3, reducing and oxidizing zones respectively, under the conditions taught in my previous U.S. Pat. No. 4,519,993, and the teachings of that patent are incorporated herein by reference insofar as may be necessary to establish the conditions of zone 2 and zone 3 to accommodate any particular waste stream makeup.

EXAMPLE 1

A liquid waste stream 18 is injected into combustion burner 12, and a gaseous portion thereof is injected into zone 2 via conduit 18A. The waste stream contains acrylonitrile and other light organic compounds, together with some water. The waste stream 18A injected into zone 2 comprises off gas having nitrile compounds and having a heating value of about 12,000 BTU/lb.

To serve as a reducing fluid, compounds should burn cleanly in a reducing environment; be nonhalogenated; and not form any hazardous compounds in absence of oxygen at the operating temperature, such as dioxanes, furans, etc. The process parameters, together with the rates of flow of the various streams are shown in Table 1.

TABLE I

| | PROCESS EXAMPLE 1 | | | | | |
|---|---|---|---|---|---|---|
| | Waste 18 | Stream 18A | Fuel 14 | Fuel 14A | Steam 17 | Air 16 |
| 1. Organic residues | 430.5 | | | | | |
| 2. Nitriles (bound) | | 79.5 | | | | |
| 3. Off gas combustibles | | 106.5 | | | | |
| 4. Water liquid | 153.0 | | | | | |
| 5. Fuel gas | | | 23.2 | 0 | | |
| 6. CO | | | | | | |
| 7. $H_2$ | | | | | | |
| 8. $CO_2$ | | | | | | |
| 9. $H_2O$ vapor | | | | | 175.0 | 40.5 |
| 10. $N_2$ | 43.2 | 342.5 | | | | 3985.4 |
| 11. $O_2$ | 13.1 | | | | | 1206.5 |
| 12. $NO_x$ (as $NO_2$) | | | | | | |
| Total LB/HR | 639.8 | 528.5 | 23.2 | 0 | 175.0 | 5232.4 |
| Temperature °F. | 70 | 350 | 70 | — | — | 70 |
| Pressure psia | 115 | 15.2 | 315 | — | 215 | 15.4 |

TABLE I-continued

| | Zone 1 20 | Zone 1 24C | Zone 2 22 | Zone 3 24 | Air 16A | Recycle 24B |
|---|---|---|---|---|---|---|
| 1. Organic residues | | | | | | |
| 2. Nitriles (bound) | | | | | | |
| 3. Off gas combustibles | | | | | | |
| 4. Water liquid | | | | | | |
| 5. Fuel Gas | | | | | | |
| 6. CO | | | 274.7 | | | |
| 7. $H_2$ | | | 19.4 | | | |
| 8. $CO_2$ | 1259.9 | 254.2 | 1078.2 | 2664.8 | | 1155.0 |
| 9. $H_2O$ vapor | 1145.6 | 238.6 | 1224.9 | 2500.8 | 18.9 | 1083.9 |
| 10. $N_2$ | 5403.7 | 1295.6 | 5832.7 | 13581.1 | 1862.3 | 5886.1 |
| 11. $O_2$ | 92.2 | 42.6 | | 446.8 | 563.8 | 193.6 |
| 12. $NO_x$ (as $NO_2$) | 900* | | <5* | 120* | | |
| Total LB/HR | 7901.4 | 1831.0 | 8429.9 | 19193.5 | 2445.0 | 8318.6 |
| Temperature °F. | 2600 | 350 | 2350 | 1600 | 70 | 350 |
| Pressure psia | 14.7 | 14.9 | 14.7 | 14.7 | 14.9 | 14.9 |

*ppm

Although the waste streams are high molecular weight compounds, soot is not a problem because zone 1 serves to preoxidize such wastes at a temperature of 2600° F., and it is possible to increase this temperature to the practical limits of the combustion chamber (which is usually about 3000° F).

FIG. 2

Although the highest $NO_x$ levels in Example 1 are about 900 ppm, it is anticipated that much higher levels could be incurred in many systems, depending on the molecular weight and nitrogen content of the input waste streams. To determine whether very high levels of $NO_x$ could be expected to be handled by the reducing zone of the present process, an experiment was conducted to expose a reducing combustion zone to high levels of $NO_x$.

In effect, the present invention involves (1) oxidation of organic wastes; (2) reduction of high $NO_x$ concentrations (or other compounds, such as bromine from brominated wastes discussed hereinbelow) formed during the combustion of nitrogenated (or halogenated) wastes; and (3) cooling and oxidation of the combustibles from the reducing zone. The two oxidation steps are proven processes, with design parameters readily available from existing technology. Much less information is available on the $NO_x$ reduction process step, and this was the focus of the test. It was hoped that it could be demonstrated that very high concentrations of $NO_x$ (in the range of approximately 45,000 ppmv) could be effectively reduced to nitrogen gas in a high temperature combustion chamber under certain process conditions. Specifically, the test was designed to determine what combination of combustibles content, temperature and residence time could produce a flue gas with essentially zero $NO_x$ content, while minimizing operating costs as well.

Figure 2:
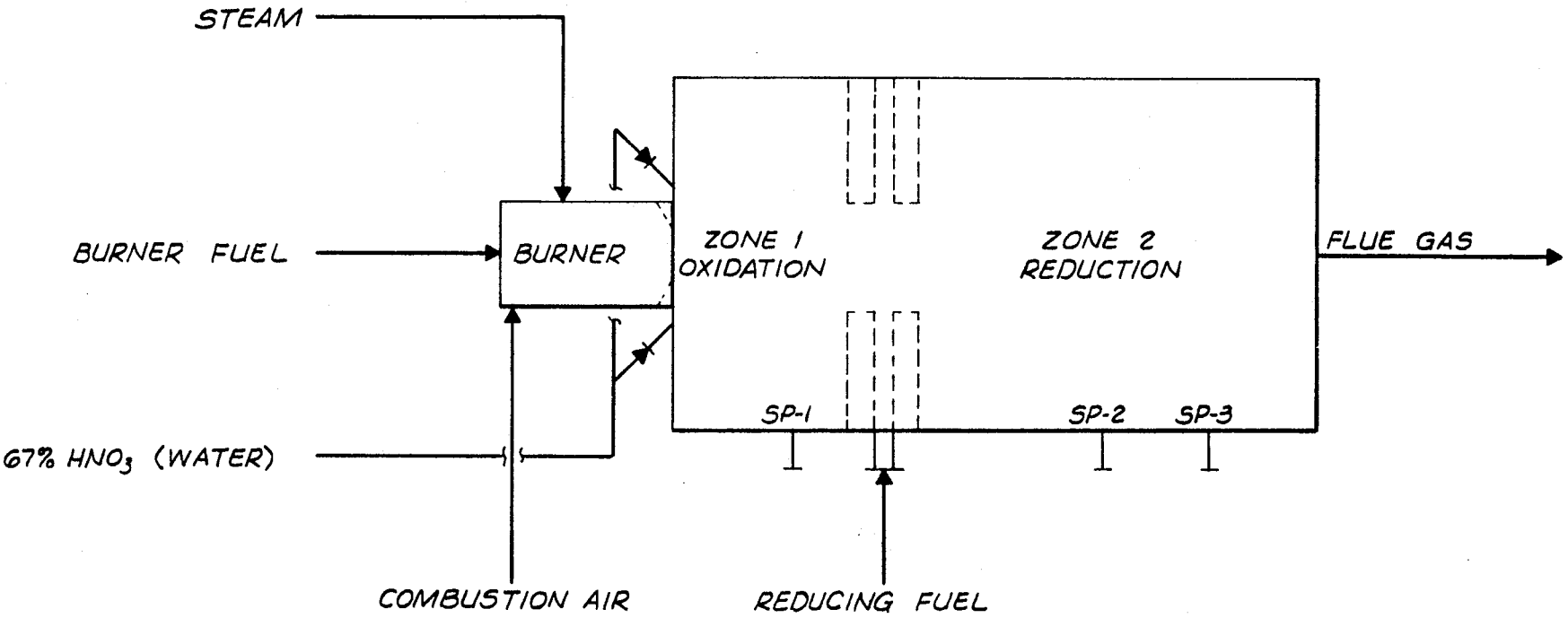
FIG. 2 is a schematic of a test equipment.

FIG. 2 is a schematic of the equipment used in the experiment. A high energy incinerator was equipped with a forced draft burner. The incinerator was 5 feet 6 inches O.D. by 22 feet 9 inches long, exclusive of the burner and stack. Flow meters were used to measure flow rates of burner fuel gas, tempering steam, combustion air and reducing fuel. Nitric acid was passed to zone 1 (the oxidation zone) at a rate measured using a digital readout platform scale and a stop watch.

Data were taken at sample point SP-1 in oxidizing zone 1, and at sample points SP-2 and SP3 in zone 2 (the reduction zone). At each sample point, the following parameters were monitored: temperature; oxygen; combustibles; and $NO_x$. In some cases, combustibles readings went over the 5 percent limit of measuring equipment, and $NO_x$ readings were over the 10,000 ppm(v) instrument limit.

Table II presents the test data and calculated results. A reference to the results tabulated therein will be augmented by a brief discussion of the test runs.

relatively moderate amount of fuel gas was introduced to the reducing zone through a body choke. The purpose of the body choke was to increase the velocity of the hot gas in order to produce a better mixture with the fuel gas injected at that point. With about 2.5% combustibles in the reducing zone, $NO_x$ was reduced to 1 ppm(v) at about 2200° F. with a one second residence time.

Run 3—The next step in working up to full run conditions was to check $NO_x$ production via the dissociation of nitric acid, at the upper limit of the $NO_x$ meter. The purpose also was to check the response time of the $NO_x$ sampling system. $NO_x$ readings rose to 8,000 ppm(v) fairly quickly, and then rose more slowly as it proceeded down the incinerator. The final reading was 10,000 ppm(v), which was the upper limit of the $NO_x$ sensor. No reducing gas was injected during this run.

Run 4—At this point, it was felt that the test apparatus had been properly prepared to produce meaningful process data. It was desirable that the first real data run have a $NO_x$ concentration that was readable on the $NO_x$ meter (i.e., less than 10,000 ppmv). Therefore, the nitric acid flow was adjusted to produce 8,000 ppm(v) $NO_x$ in the oxidizing zone. The flow of reducing gas was increased until the combustibles meter read just under 5% for the reducing zone. By the time the sample gas reached the analytical cell, it had cooled to atmospheric temperature and most of the water had condensed and collected in a trap. Consequently, a reading

TABLE II

| Data Point | RUN NUMBER 1 | 2 | 3 | 4 | 5 | 6 |
|---|---|---|---|---|---|---|
| Furnace Temp. (°F.) | | | | | | |
| SP-1 | 2200 | 2390 | 2260 | 2220 | 2110 | 2140 |
| SP-2 | 2010 | 2140 | 2110 | 2140 | 2180 | 2130 |
| SP-3 | 1960 | 2030 | 2050 | 2080 | 2140 | 1890 |
| $O_2$/Comb (%) | | | | | | |
| SP-1 | 1.3/0 | 1.3/0 | 2.2/0 | 1.5/0.5 | 2.0/0 | 1.6/0 |
| SP-2 | 1.6/0 | 0.25/2.3 | 2.0/0.1 | 0/4.5 | 0/5+ | 0/2.0 |
| SP-3 | 1.6/0 | 0/2.5 | 1.45/0 | 0/5 | 0/5+ | 0/2.0 |
| NOx (ppmv) | | | | | | |
| SP-1 | 12 | 180 | 8,000 | 8,000 | 76,400* | 52,500* |
| SP-2 | 12 | 1 | 9,000 | 3 | 3 | 4 |
| SP-3 | 12 | 0.55 | 10,000 | 4 | 4 | 4 |
| Residence Time (Sec.)* | | | | | | |
| SP-1 | 0.75 | 0.85 | 0.76 | 0.78 | 1.08 | 0.94 |
| SP-2 | 0.92 | 1.01 | 0.92 | 0.89 | 1.16 | 1.06 |
| SP-3 | 1.41 | 1.57 | 1.42 | 1.37 | 1.78 | 1.68 |
| Fuel Gas to Burner Flow (scfm) | 46.6 | 46.6 | 46.2 | 46.2 | 43.0 | 43.0 |
| Fuel Gas to Reduction Zone Flow (scfm) | 0 | 8.06 | 0 | 16.13 | 28.05 | 18.82 |
| Combustion Air Flow (scfm) | 480 | 460 | 460 | 460 | 340 | 340 |
| Tempering Steam Flow (lb/hr) | 328 | 0 | 572 | 584 | 0 | 328 |
| Nitric Acid Flow (lb/hr) | 0 | 0 | 120 | 75 | 624 | 491 |
| Quench Water Flow (gpm) | 0.72 | 0.72 | 0 | 0 | 0 | 0 |

*Calculated Results

Run 1—Determination of the fuel-derived base level $NO_x$ was the purpose of this run. With tempering steam added to the burner plenum, base level $NO_x$ was only 12 ppm(v). Water was sprayed into the incinerator downstream of the burner to moderate the temperature in the oxidizing zone to 2200° F., while maintaining the $O_2$ content at between 1 and 2%.

Run 2—Beginning with the conditions of Run 1, tempering steam was cut off to give a more meaningful background $NO_x$ reading of 180 ppm(v). In addition, a of 5% combustible on the meter corresponded to an actual combustibles content in the incinerator gas of about 3%. The $NO_x$ reduction was immediate and dramatic when the reducing gas reached the proper flow rate, dropping from 8,000 to 3 ppm(v) between the reducing gas injection point and SP-2, a distance of 4'-6". The run conditions were 0.9 sec. residence time at an average temperature of 2180° F., with 4.5% combustibles on a dry basis (about 3% on a wet basis).

Run 5—The next step was to increase the nitric acid flow rate to such a large degree that a $NO_x$ concentration considerably in excess of 45,000 ppm(v) was produced, a level that a commercial unit might encounter. Nitric acid was introduced into the oxidizing zone at a rate of 624 lb/hr, which corresponds to a calculated $NO_x$ concentration of 76,400 ppm(v). The reducing gas input was increased to give a combustibles level of just over 5%, corresponding to about 3.5% on a wet basis. With an average temperature of 2145° F. and a residence time of 1.15 sec., $NO_x$ was reduced from 76,400 ppm(v) to 3 ppm(v).

Run 6—The purpose of this run was to simulate full scale conditions more closely regarding $NO_x$ concentration, while at the same time reducing combustibles content significantly. The operation was at an average temperature of 2135° F., with a residence time of 1.04 sec. and combustibles content of 2.0% (1.2% on a wet basis). Under these conditions, calculated $NO_x$ level was 52,500 ppm(v), at SP-1. This was reduced to 4 ppm at SP-3. This verifies that full scale operations can be conducted at 2200° F., 5% combustibles, and 1 second residence time, and these are considered conservative.

In present commercial incinerators burning nitrogenated wastes, it is difficult to operate the equipment in such a manner so as to oxidize the combustibles and simultaneously minimize or eliminate the production of $NO_x$ in the flue gas. The present inventive process accomplishes this objective in a multistage system: an initial oxidation zone; a reduction zone; and a final oxidation zone. The above discussed test was conducted to study the reduction zone. As stated above, the test provided confirmation that the reduction zone is capable of operating satisfactorily when the input waste stream has a nitrogenated constituency. The test verified that the temperature range selected is appropriate (between about 2100° F. and 2200° F.), that a combustibles content in the range of about 2 percent to 5 percent is achievable, and that a residence time of between about 0.9 to 1.2 seconds is sufficient to ensure virtual completion of the reduction reactions. Therefore, the design parameters of a full scale commercial reduction zone would be appropriately established, for example, with operation conditions of 2200° F., one second residence time, and 5 percent combustibles in the effluent therefrom. Once stabilized, it is expected that combustibles content can be lowered to considerably below the 5 percent level.

FIG. 3

Figure 3:
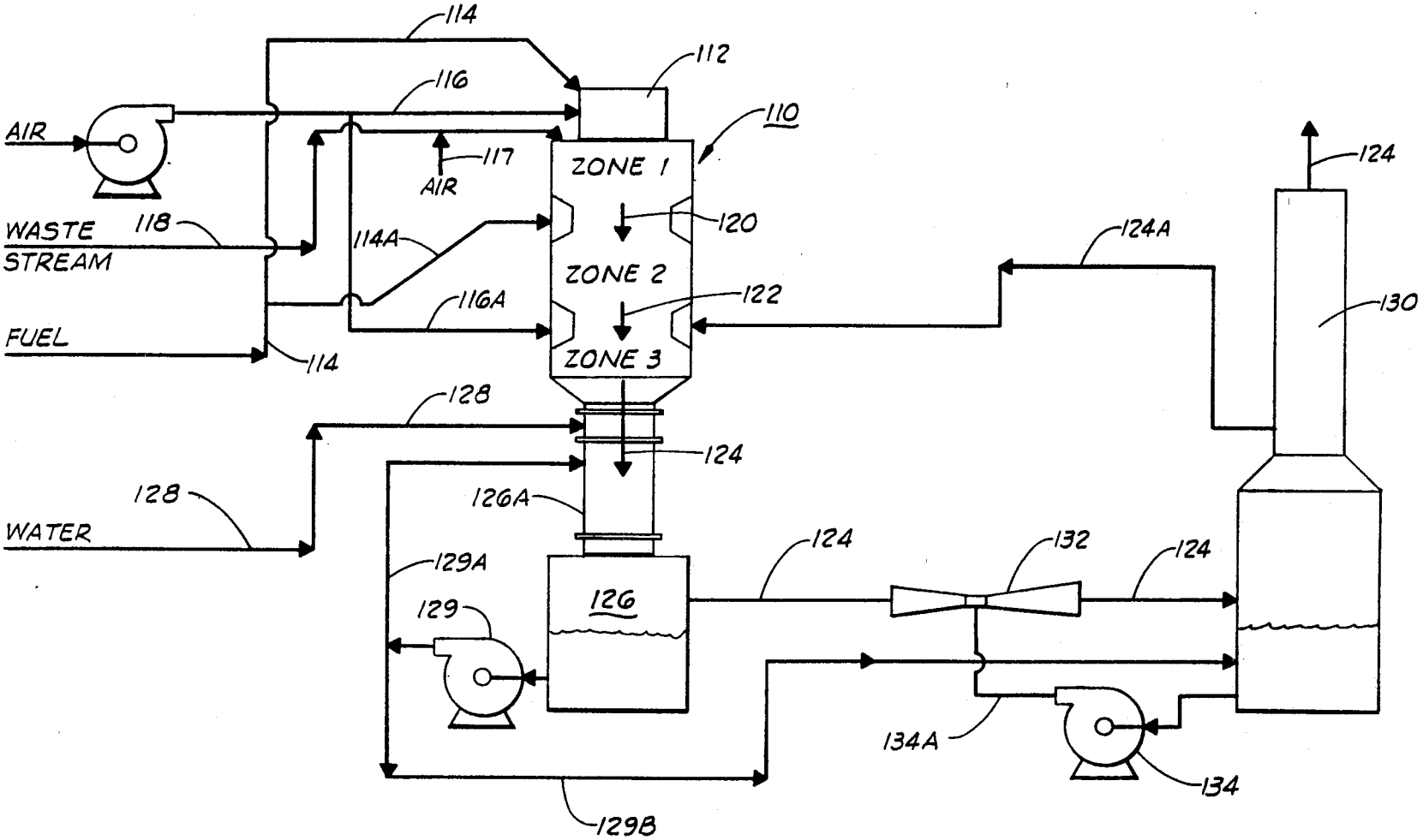
FIG. 3 is a schematic flow diagram showing another embodiment of the process of the present invention.

Turning now to FIG. 3, shown therein is a combustion chamber 110 which is schematically depicted and which has three combustion zones in linear alignment, namely: zone 1—oxidation; zone 2—reduction; and zone 3—oxidation. A burner 112 is provided at the input end (zone 1), and a fuel stream 114, a combustion air stream 116 and an atomizing air stream 117 are connected for injection to the burner 112. In FIG. 3, the process depicted therein is for a liquid waste stream which has constituents which, upon oxidation, forms some amount of solid materials, some of which form molten slag. Typical of such compounds are nitrated organic compounds and nitrated sodium salts that form particulates and/or molten slag at oxidation temperatures.

In FIG. 3, the fuel stream 114 has a conduit 114A which is used as necessary to inject fuel to reducing zone 2. Also, there is provided a conduit 116A for directing a portion of combustion air to oxidizing zone 3. A waste chemical stream 118 is directed to the burner 112, and although not shown, a conduit can be provided to direct a portion of the input liquid waste stream into reducing zone 2 when it has fuel value and satisfactory combustion characteristics, which will not normally be the case for a liquid waste.

Zone 1 produces a combustion effluent 120 which is passed immediately to zone 2, which in turn produces a combustion effluent 122 (also sometimes herein referred to as the first combusted waste effluent stream). The combustion effluent 122 (also sometimes referred to herein as the second combusted waste effluent stream) is passed immediately to oxidizing zone 3, from which is discharged a combustion effluent 124 (also sometimes referred to herein as the third combusted waste effluent stream). Since combustion of this liquid waste produces particulates and molten slag, the combustion chamber 110 is vertically disposed over a quench tank 126 disposed to receive both the gaseous and slag effluents from the combustion chamber 110. The present invention is unique in that it permits the addition of a primary combustion chamber, such as a rotary kiln or a fluid bed (not shown), as a precursor treatment of solid or sludge materials (as illustrated hereinbelow in FIG. 4) which cannot be injected via normal conduits into zone 1.

Fresh water 128 is fed to the top of a downcomer section 126A of the quench tank 126, and a pump 129 continuously recirculates accumulated water from the bottom of the quench tank 126 to the top of the downcomer 126A via conduit 129A. Also, via controls and valving not shown in FIG. 3, the pump 129 passes accumulated water from the bottom of the quench tank 126 via conduit 129B to a combined accumulator and vent stack 130, thereby maintaining a selected liquid level in the bottom of the quench tank 126. An appropriate blowdown (not shown) can be provided.

A portion of the discharged combustion effluent 124 may be returned as a diluent to oxidizing zone 3 via a conduit 124A, or to other points in the combustion chamber 110, as desired.

As discussed hereinabove, burning of the waste chemical stream 118 is accomplished in oxidizing zone 1 which is operated with an excess of oxygen above that required for stoichiometric combustion. The temperature and residence time should be consistent with good combustion practice, with the design parameters discussed hereinabove maintained. Reducing zone 2 is designed to treat the combustion effluent 120 in the presence of fuel to burn oxygen and at about 2000° F., minimum, to provide combustibles in combustion effluent 122 of about 3 to 5 percent (wet volume). Also as stated above, it may be desirable to operate zones 2 and 3 under the process parameters and conditions taught in U.S. Pat. No. 4,519,993 as may be required to accommodate and particular waste stream makeup.

Also shown in FIG. 3 is venturi scrubber 132, or any suitable particulate scrubber, to remove particulates that are not caught in the downcomer section 26A. Water is circulated from the bottom of the vent stack 130 via pump 134 and conduit 134A.

EXAMPLE 2

A liquid waste chemical stream 118 is injected into combustion burner 112, with atomizing air 117. The waste stream is a liquid stream containing nitrated compounds which produce particulates and slag when oxidized. More particulars and process parameters are provided in Table III for this example to illustrate the process depicted in FIG. 3.

TABLE III

PROCESS EXAMPLE 2

| | Waste Stream 118 | Air 117 | Fuel 114 | Fuel 114A | Air 116 | Air 116A |
|---|---|---|---|---|---|---|
| 1. Water and nitrated compounds including organic salts. | 8,000.0 | | | | | |
| 2. Fuel Gas $CH_4$ | | | 268.0 | 392.7 | | |
| 3. $CO_2$ | | | | | | |
| 4. CO | | | | | | |
| 5. $H_2O$ (Vapor) | | 9.4 | | | 113.5 | 52.3 |
| 6. $H_2$ | | | | | | |
| 7. $N_2$ | | 921.6 | | | 11108.3 | 5123.8 |
| 8. $O_2$ | | 279.0 | | | 3362.8 | 1551.1 |
| 9. $Na_2O$ | | | | | | |
| 10. NaBr | | | | | | |
| 11. $Na_2CO_3$ | | | | | | |
| 12. NOx | | | | | | |
| Total LB/HR | 8000.0 | 1210.0 | 268.0 | 392.7 | 14584.6 | 6727.2 |
| Temperature °F. | 120 | 70 | 70 | 70 | 70 | 70 |
| Presssure, psi | 155 | 115 | 30 | 30 | 16.8 | 16.8 |

| | Zone 1 120 | Zone 2 122 | Zone 3 124 | Recycle 124A | Water 128 | Stack 124 |
|---|---|---|---|---|---|---|
| 1. Water and nitrated compounds including organic salts. | | | | | 40276.1 | |
| 2. Fuel Gas $CH_4$ | | | | | | |
| 3. $CO_2$ | 4155.1 | 4345.6 | 5971.3 | 738.9 | | 4392.2 |
| 4. CO | | 564.4 | | | | |
| 5. $H_2O$ (Vapor) | 5209.5 | 5636.9 | 10811.9 | 4668.1 | | 27746.7 |
| 6. $H_2$ | | 50.9 | | | | |
| 7. $N_2$ | 12128.5 | 12623.2 | 20732.8 | 2985.8 | | 17747.0 |
| 8. $O_2$ | 275.3 | | 963.8 | 138.8 | | 825.0 |
| 9. $Na_2O$ | 1183.2 | 1183.2 | 1183.2 | | | |
| 10. NaBr | 51.9 | 51.9 | 51.9 | | | 0.0 |
| 11. $Na_2CO_3$ | | | | | | 0.5 |
| 12. NOx | 1059.9 | | | | | <120* |
| Total LB/HR | 24063.4 | 24456.1 | 39714.9 | 8531.6 | 40276.1 | 50711.4 |
| Temperature °F. | 1800 | 2220 | 1800 | 192 | 70 | 192 |
| Presssure, psi | 16.555 | 16.537 | 16.518 | 16.790 | 90 | 14.520 |

*ppm

Table III provides the major flow streams for the process of FIG. 3, and it will be clear from a review thereof that the present invention provides good preoxidation for a nitrated stream without the troublesome products often associated therewith.

FIG. 4

Figure 4:
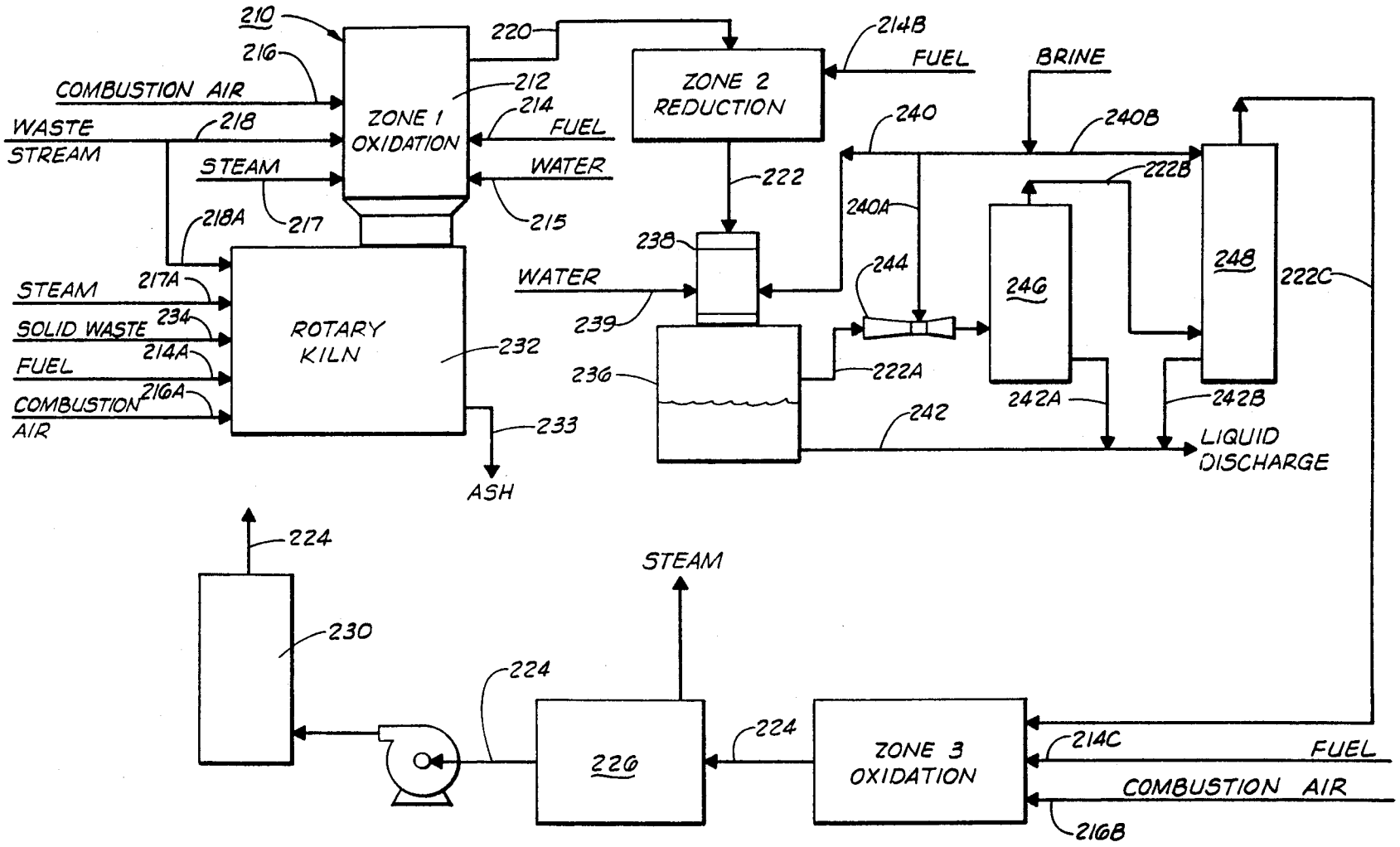
FIG. 4 is a schematic flow diagram showing yet one other embodiment of the process of the present invention.

Turning now to FIG. 4, schematically depicted therein is another embodiment of the process of the present invention to accommodate a brominated waste stream which produces free bromine gas when combusted in an oxidizing atmosphere, and which also produces a solid ash by-product. A combustion process 210 has multiple combustion chambers which, unlike the processes discussed above, are not in linear alignment, namely: zone 1, an oxidation zone; zone 2, a reduction zone; and zone 3, another oxidation zone. In this case, it will be noted that these zones are separated by other unit operations. A burner 212 is provided in zone 1, and a fuel stream 214, a water stream 215, a combustion air stream 216 and an atomized steam stream 217 are provided. A waste stream 218 is injected into an oxidation zone 1 which produces a combustion effluent 220 (also sometimes referred to herein as the first combusted waste effluent stream) that is passed to the reduction zone 2. Fuel 214B is injected into reducing zone 2, and this zone produces a combustion effluent 222 (also sometimes referred to herein as the second combusted waste efluent stream) which is passed to the oxidizing zone 3. A combustion effluent 224 (also sometimes referred to herein as the third combusted waste effluent stream) is discharged from zone 3 and preferably is passed through a waste heat boiler 226 before passing to a stack 230 for discharge. Fuel 214C and combustion air 216B are injected into zone 3.

It will be noted that zone 1 is disposed over a rotary kiln 232 to function as an afterburner in addition to its function as an initial oxidation zone for liquid waste. Steam 217A, solid waste 234, fuel 214A and combustion air 216A are injected into the rotary kiln 232 to support combustion, and flue gas created thereby is further burned in zone 1, which serves as an afterburner or secondary combustor to achieve maximum destruction of the waste, and then becomes part of the combustion effluent 220 which is exhausted from zone 1 and is directed to zone 2.

Disposed beneath zone 2 is a quench tank 236 and a weir/downcomer 238 provided therebetween, and a fresh water stream 239 is fed thereto. The combustion effluent 222 passes downwardly to the quench tank 236 in contact with the water stream 239 and another water stream 240 (in FIG. 4 a brine) fed to the weir/downcomer 238. The gaseous effluent and ash particulates from the reducing zone 2 are received in the quench tank 236, and a liquid discharge 242 is exhausted therefrom for further processing as may be required. Not shown is a water stream which serves to quench discharge ash 233 from the rotary kiln 232, and a portion of such water stream can be mixed with the liquid discharge 242.

The combustion effluent 222 is designated as combustion effluent 222A as it is exhausted from the quench tank 236, and this effluent 222A is passed through a venturi scrubber 244 to remove particulates not caught in the quench tank 236. A portion of the brine stream 240A is fed thereto, and the combined liquid and effluent 222A are passed to a liquid separator 246, from where a bottom liquid discharge 242A and a top combustion effluent 222B are exhausted. The liquid discharge 242A joins the liquid discharge 242, while the combustion effluent 222B passes to an absorber 248 to which a portion of the brine stream 240B is fed. The purpose for this arrangement is to recover hydrogen bromide (HBr) in a sodium bromide brine which is processed in other bromide equipment (not shown) for bromine recovery.

The combustion effluent 222 is designated as combustion effluent 222C as it is exhausted from the top of the absorber 248 and is passed to oxidation zone 3, while a bottom liquid discharge 242B joins the liquid discharge 242.

Combustion occurs in zone 3 into which are injected a fuel stream 214C and a combustion air stream 216B. The combustion effluent 224 created in zone 3 is passed to the waste heat boiler 226 for discharge from the stack 230.

It will be appreciated that the process of FIG. 4 encompasses the three combustion zones described earlier hereinabove together with the other unit operations just described. The following example provides typical process parameters.

EXAMPLE 3

Tables IVA and IVB are included to provide the process parameters for liquid and solid waste streams that are treated by the process of FIG. 4. These tables demonstrate the efficacy of the present process to treat certain halogenated and nitrated wastes in a manner which meets regulatory discharge criteria while eliminating, minimizing or recovering products from the combustion of liquid and solid waste chemical streams.

Example 4 illustrates the use of the present invention where hazardous wastes, liquid and solid, containing bromine must be made acceptable to meet regulatory discharge codes. With the addition of the rotary kiln 232, solid wastes are readily handled, as the gaseous effluent therefrom is passed to zone 1 which receives the liquid waste stream 218 for preoxidation. Thus, zone 1 serves as a secondary combustor or afterburner to the rotary kiln 232; this arrangement serves to meet presently imposed federal regulatory guidelines for incineration of halogenated hazardous wastes.

This establishes a starting point for the destruction of halogenated waste materials, but absent the remaining portion of the present process, the created by-products could not be discharged to the environment. While other prior art operations can acceptably be used to deal with these by-products, the present process provides an efficient means to do so while avoiding other objectionable results. For example, the use of caustic scrubbing to remove bromine gas generated by oxidation of brominated wastes, in addition to being expensive, can form unstable hypobromite compounds causing unacceptable water treatment and bromine recovery problems. Small quantities of bromine gas can produce a brownish gaseous effluent from the scrubber. These difficulties are prevented by the present invention, while at the same time, the bromide compounds are convertible to recoverable bromine products because the bromine is converted to hydrogen bromide which can easily be dealt with by conventional bromine recovery processes.

In Example 4, a sodium bromide brine solution 240 is used to absorb the hydrogen bromide gas generated in zone 2. The resulting solution is acceptable for bromine recovery. Thus, Example 4 illustrates the integration of the present inventive process with other unit operations to achieve acceptable destruction of nitrated and halogenated compounds while avoiding the production of objectionable secondary emissions. Thus, substantially any material, whether solid, liquid or gas, can be properly burned by the present inventive process.

It will be clear that the present invention is well adapted to carry out the objects and attain the advantages mentioned as well as those inherent therein. While presently preferred embodiments of the invention have been described for purposes of this disclosure, numerous changes can be made which will readily suggest themselves to those skilled in the art and which are encompassed within the spirit of the invention disclosed and as defined in the appended claims.

TABLE IVA.

| PROCESS EXAMPLE 3 | Waste Streams | | |
|---|---|---|---|
| | 218 | 218A | 234 |
| 1. Carbon (C) | 391.6 | 81.3 | 71.7 |
| 2. Hydrogen (H) | 28.2 | 5.9 | 6.1 |
| 3. Oxygen (O) | 10.6 | 2.2 | 13.1 |
| 4. Water ($H_2O$) | 27.3 | 5.7 | 353.5 |
| 5. Chlorine (Cl) | 161.7 | 33.5 | 2.8 |
| 6. Sulfur (S) | 0.0 | 0.0 | 0.9 |
| 7. Bromine (Br) | 582.1 | 120.8 | 167.5 |
| 8. Nitrogen (N) | 0.9 | 0.2 | 0.0 |
| 9. Ash | 26.6 | 5.5 | 126.5 |
| Total (lb/HR) | 1229.0 | 255.1 | 742.1 |
| Temperature, °F. | 70 | 70 | 70 |
| Pressure, PSIA | 94.6 | 94.6 | — |
| Gas Flow (ACFM) | — | — | — |
| Liquid Flow (GPM) | 2.5 | 0.5 | — |

TABLE IVB

| PROCESS EXAMPLE 3 | Steam 217A | Fuel 214A | Air 216A | Ash 233 | Steam 217 | Air 216 | Fuel 214 | Water 215 | Effluent 220 | Fuel 214B | Effluent 222 |
|---|---|---|---|---|---|---|---|---|---|---|---|
| 1. Carbon Dioxide ($CO_2$) | | | | | | | | | 2053.3 | | 2185.3 |
| 2. Water Vapor ($H_2O$) | 90.0 | | 31.9 | | 430.0 | 55.8 | | | 2214.3 | | 2368.9 |
| 3. Nitrogen ($N_2$) | | | 2451.4 | | | 4279.7 | | | 6754.1 | | 6754.1 |
| 4. Sulfur Dioxide ($SO_2$) | | | | | | | | | 1.9 | | 1.9 |
| 5. Oxygen ($O_2$) | | | 740.0 | | | 1292.0 | | | 306.7 | | 0.0 |

TABLE IVB-continued

| | | | | | | | | | | | |
|---|---|---|---|---|---|---|---|---|---|---|---|
| 6. Hydrogen Chloride (HCl) | | | | | | | | | 203.6 | | 203.6 |
| 7. Hydrogen Bromide (HBr) | | | | | | | | | 528.8 | | 881.5 |
| 8. Ash | | | | 112.2 | | | | | 46.4 | | 46.4 |
| 9. Fuel ($CH_4$) | | | | | | | 14.0 | | | 121.8 | |
| 10. Water Liquid ($H_2O$) | | 7.0 | | | | | | 891.7 | | | |
| 11. Bromine ($Br_2$) | | | | | | | | | 348.2 | | 0.0 |
| 12. Carbon Monoxide (CO) | | | | | | | | | | | 128.6 |
| 13. Hydrogen ($H_2$) | | | | | | | | | | | 8.9 |
| 14. Dissolved Solids | | | | | | | | | | | |
| 15. $NO_x$ | | | | | | | | | | | |
| Total (lb/HR) | 90.0 | 7.0 | 3223.3 | 112.2 | 430.0 | 5627.5 | 14.0 | 891.7 | 12457.3 | 121.8 | 12579.2 |
| Temperature, °F. | 338 | 70 | 70 | 1800 | 338 | 70 | 70 | 70 | 2200 | 70 | 2320 |
| Pressure, PSIA | 114.6 | 49.6 | 14.8 | | 114.6 | 15.30 | 49.6 | 94.6 | 14.54 | 49.4 | 14.50 |
| Gas Flow (ACFM) | 5.8 | 0.8 | 720 | — | 27.9 | 1215 | 1.7 | — | 14266 | 14.5 | 15404 |
| Liquid Flow (GPM) | — | — | — | — | — | — | — | 1.78 | — | — | — |

| | Water 239 | Brine 240 | Effluent 222A | Discharge 242 | Brine 240A | Brine 240B | Effluent 222B |
|---|---|---|---|---|---|---|---|
| 1. Carbon Dioxide ($CO_2$) | | | 2185.3 | | | | 2185.3 |
| 2. Water Vapor ($H_2O$) | | | 8772.4 | | | | 8486.4 |
| 3. Nitrogen ($N_2$) | | | 6754.1 | | | | 6754.1 |
| 4. Sulfur Dioxide ($SO_2$) | | | 1.9 | | | | 1.9 |
| 5. Oxygen ($O_2$) | | | | | | | |
| 6. Hydrogen Chloride (HCl) | | | 183.3 | 20.3 | | | 128.3 |
| 7. Hydrogen Bromide (HBr) | | | 793.3 | 88.2 | | | 555.3 |
| 8. Ash | | | 41.7 | 4.7 | | | 1.7 |
| 9. Fuel ($CH_4$) | | | | | | | |
| 10. Water Liquid ($H_2O$) | 10,000.0 | 23,532.0 | | 27,128.5 | 44,400.0 | 53,280.0 | |
| 11. Bromine ($Br_2$) | | | | | | | |
| 12. Carbon Monoxide (CO) | | | 128.6 | | | | 128.6 |
| 13. Hydrogen ($H_2$) | | | 8.9 | | | | 8.9 |
| 14. Dissolved Solids | | 8,268.0 | | 8,268.0 | 15,600.0 | 18,720.0 | |
| 15. $NO_x$ | | | | | | | |
| Total (lb/HR) | 10,000.0 | 31,800.0 | 18,869.5 | 35,509.7 | 60,000.0 | 72,000.0 | 18,250.5 |
| Temperature, °F. | 70 | 185 | 195 | 195 | 185 | 185 | 193 |
| Pressure, PSIA | 94.6 | 94.6 | 14.43 | | 94.6 | 94.6 | 12.98 |
| Gas Flow (ACFM) | — | — | 6505 | — | — | — | 70.26 |
| Liquid Flow (GPM) | 20 | 53 | — | 60.5 | 100 | 120 | — |

| | Discharge 242A | Effluent 222C | Discharge 242B | Fuel 214C | Air 216B | Effluent 224A |
|---|---|---|---|---|---|---|
| 1. Carbon Dioxide ($CO_2$) | | 2183.6 | 1.7 | | | 4,668.6 |
| 2. Water Vapor ($H_2O$) | | 8281.7 | | | 186.6 | 10,418.9 |
| 3. Nitrogen ($N_2$) | | 6754.1 | | | 14,330.2 | 21,083.2 |
| 4. Sulfur Dioxide ($SO_2$) | | 1.9 | | | | 1.9 |
| 5. Oxygen ($O_2$) | | | | | 4,326.0 | 857.6 |
| 6. Hydrogen Chloride (HCl) | 55.0 | 1.3 | 127.0 | | | 1.3 |
| 7. Hydrogen Bromide (HBr) | 238.0 | 0.6 | 554.7 | | | 0.6 |
| 8. Ash | 40.0 | 1.5 | .2 | | | 1.5 |
| 9. Fuel ($CH_4$) | | | | 832.9 | | |
| 10. Water Liquid ($H_2O$) | 44,686.0 | | 53,484.7 | | | |
| 11. Bromine ($Br_2$) | | | | | | |
| 12. Carbon Monoxide (CO) | | 128.6 | | | | 1.2 |
| 13. Hydrogen ($H_2$) | | 8.9 | 18,720.0 | | | |
| 14. Dissolved Solids | 15,600.0 | | | | | 3.0 |
| 15. $NO_x$ | | | | | | |
| Total (lb/HR) | 60,619.0 | 17,362.2 | 72,888.3 | 832.9 | 18,842.8 | 37,037.8 |
| Temperature, °F. | 193 | 193 | 193 | 70 | 70 | 560 |
| Pressure, PSIA | | 12.76 | | 49.6 | 14.6 | 14.6 |
| Gas Flow (ACFM) | — | 6949 | — | 99.2 | 4264 | 18,285 |
| Liquid Flow (GPM) | 101 | — | 122 | — | — | — |

What is claimed is:

1. An apparatus for destructively combusting waste materials comprising:

a combustion chamber having a top end and a bottom end and including a first oxidation zone, a reduction zone, and a second oxidation zone, said zones being vertically aligned such that said first oxidation zone is positioned at said stop end of said combustion chamber, said second oxidation zone is positioned at said bottom end of said combustion chamber, said first oxidation zone is positioned directly above said reduction zone, and said reduction zone is positioned directly above said second oxidation zone;

a burner associated with said first oxidation zone;

a quench tank positioned below said bottom end of said combustion chamber;

a downcomer means, positioned between said bottom end of said combustion chamber and said quench tank, for delivering a combustion effluent from said second oxidation zone to said quench tank;

first conduit means for conducting a fuel to said burner;

second conduit means for conducting an oxygen source to said burner;

third conduit means for conducting a waste material to said first oxidation zone;

fourth conduit means for conducting a reducing agent to said reducing zone;

fifth conduit means for conducting an oxygen source to said second oxidation zone; and sixth conduit means for conducting water through said downcomer means in contact with said combustion effluent.

2. An apparatus as described in claim 1 further comprising:

a vent stack for expelling said combustion effluent to the atmosphere;

a seventh conduit means for conducting said combustion effluent from said quench tank to said vent stack; and a scrubber means, disposed in said seventh conduit means, for removing particulates from said combustion effluent.

3. An apparatus for destructively combusting a waste material comprising:

a first oxidation means for oxidating said waste material using a fuel and a stoichiometric excess, based on the total amount of said waste material and said fuel, of oxygen such that substantially complete oxidation of said waste material is achieved and a free oxygen-containing first oxidation means effluent stream is produced;

a reducing means, positioned directly below said first oxidation means, for reducing said first oxidation means effluent stream in the presence of a stoichiometric excess, based on the amount of free oxygen contained in said first oxidation means effluent stream, of a reducing agent such that a reduction effluent is produced which includes an amount of oxidizable material;

a second oxidation means, positioned directly below said reducing means, for oxidizing said reduction effluent in the presence of a stoichiometric excess, based on the amount of oxidizable material contained in said reduction effluent, of oxygen to produce a second oxidation zone effluent stream; and a quench means, positioned directly below said second oxidation means, for quenching said second oxidation zone effluent stream with water.

4. An apparatus as described in claim 3 wherein said quench means includes:

a downcomer positioned directly below said second oxidation means and a conducting means for conducting at least a portion of said water through said downcomer.

5. An apparatus as described in claim 3 further comprising:

a removing means for removing a particulate material from said second oxidation zone effluent stream and a first conduit means for conducting said second oxidation zone effluent stream from said quench means to said removing means.

6. An apparatus as described in claim 5 further comprising a second conduit means for conducting a portion of said second oxidation zone effluent stream from said removing means to at least one of said first oxidation means, said reducing means, and said second oxidation means.

7. An apparatus for destructively combusting waste materials comprising:

a first oxidation means for oxidizing a first waster material using a fuel and a stoichiometric excess, based on the total amount of said first waste material and said fuel, of oxygen such that substantially complete oxidation of said first waste material is achieved and a free oxygen-containing first oxidation means effluent gas stream is produced;

a reducing means for reducing said first oxidation means effluent gas stream in the presence of a stoichiometric excess, based on the amount of free oxygen contained in said first oxidation means effluent gas stream, of a reducing agent such that a reduction effluent gas stream is produced which includes an amount of oxidizable material;

a recovery means for recovering a halogen-containing product formed in at least one of said first oxidation means and said reducing means from said reduction effluent gas stream; and a second oxidation means for oxidating said reduction effluent gas stream, after said reduction effluent gas stream passes through said recovery means, in the presence of a stoichiometric excess, based on the amount of oxidizable material in said reduction effluent gas stream, of oxygen to produce a second oxidation means effluent gas stream.

8. An apparatus as described in claim 7 wherein said first oxidation means includes a burner.

9. An apparatus as described in claim 8 wherein:

the source of said oxygen used in at least one of said first oxidation means and said second oxidation means is air and said second oxidation means is operable for oxidizing said reduction effluent gas stream in a manner such that said second oxidation means effluent gas stream is substantially $NO_x$-free.

10. An apparatus as described in claim 8 further comprising a removing means for removing a particulate material from said reduction effluent gas stream before said reduction effluent gas stream is oxidized in said second oxidation means.

11. An apparatus as described in claim 8 wherein:

said halogen-containing product is a hydraulic acid and said recovery means comprises means for contacting said reduction effluent gas stream with an aqueous medium.

12. An apparatus as described in claim 8 further comprising:

a burning means for burning a solid waste material using a fuel to produce a burning means effluent gas stream and conducting means for conducting said burning means effluent gas stream from said burning means to said first oxidation means.

13. An apparatus as described in claim 12 wherein said burning means comprises a rotary kiln.

14. An apparatus for destructively combusting waste material comprising:

a combustion means for combusting a solid waste material using a fuel and a stoichiometric excess, based on the total amount of said solid waste material and said fuel, of oxygen such that substantially complete oxidation of said solid waste material is achieved and a combustion means effluent gas stream is produced which includes an amount of free oxygen;

a reducing means for reducing said combustion means effluent gas stream in the presence of a stoichiometric excess, based on the amount of free oxygen contained in said combustion means effluent gas stream, of a reducing agent such that a reduction effluent gas stream is produced which includes an amount of oxidizable material; and a secondary oxidation means for oxidizing said reduction effluent gas stream in the presence of a stoichiometric excess, based on the amount of oxidizable material in said reduction effluent gas, of oxygen to produce a secondary oxidation means effluent gas stream.

15. An apparatus as described in claim 14 wherein said combustion means comprises:

a burning means for burning said solid waste material to produce a burning means effluent gas stream and a primary oxidation means for oxidizing said burning means effluent gas stream using a stoichiometric excess, based on the total amount of fuel and other oxidizable material passing through said primary oxidation means, of oxygen such that substantially complete oxidation of said burning means effluent gas stream is achieved and said combustion means effluent gas stream is produced.

16. An apparatus as described in claim 15 wherein said burning means comprises a rotary kiln.

17. An apparatus as described in claim 16 wherein said primary oxidation means includes a burner.

18. An apparatus as described in claim 15 wherein said primary oxidation means further comprises means for oxidizing a second waste material in said primary oxidation means such that substantially complete oxidation of said second waste material in said primary oxidation means is achieved and the oxidation of said second waste material in said primary oxidation means produces an oxidation product gas, said oxidation product gas being included in said combustion means effluent gas stream.

19. An apparatus as described in claim 15 wherein:

the source of said oxygen used in at least one of said burning means, said primary oxidation means, and said secondary oxidation means is air and said secondary oxidation means is operable for oxidizing said reduction gas efluent stream in a manner such that said secondary oxidation means effluent gas steam is substantially $NO_x$-free.

20. An apparatus as described in claim 15 further comprising a recovery means for recovering a halogen-containing product produced in at least one of said burning means, said primary oxidation means, and said reduction means from said reduction effluent gas stream before said reduction effluent gas stream is oxidized in said secondary oxidation means.

21. An apparatus as described in claim 20 wherein:

said halogen-containing product is a hydrohalic acid and said recovery means comprises means for contacting said reduction effluent gas stream with water.

22. An apparatus as described in claim 15 further comprising removing means for removing a particulate material from said reduction effluent gas stream before said reduction effluent gas stream is oxidized in said secondary oxidation means.

23. An apparatus as described in claim 1 wherein:

said first oxidation zone is a catalyst-free oxidation zone;

said reduction zone is a catalyst-free reduction zone; and said second oxidation zone is a catalyst-free oxidation zone.

24. An apparatus as described in claim 3 wherein:

said first oxidation means is a catalyst-free oxidation means;

said reducing means is a catalyst-free reducing means; and said second oxidation means is a catalyst-free oxidation means.

25. An apparatus as described in claim 7 wherein:

said first oxidation means is a catalyst-free oxidation means;

said reducing means is a catalyst-free reducing means; and said second oxidation means is a catalyst-free oxidation means.

26. An apparatus as described in claim 14 wherein:

said combustion means is a catalyst-free combustion means;

said reducing means is a catalyst-free reducing means; and said secondary oxidation means is a catalyst-free oxidation means.

* * * * *